US006381968B1

(12) United States Patent
O'Donoghue, Jr. et al.

(10) Patent No.: US 6,381,968 B1
(45) Date of Patent: May 7, 2002

(54) APPARATUS AND METHOD FOR FORMING ICE AND FROSTED SCULPTURES

(76) Inventors: Joseph O'Donoghue, Jr., 220 Plymouth St. - Suite 5A, Brooklyn, NY (US) 11201; Charles Ippolito, 1762 E. 52nd St., Brooklyn, NY (US) 11234

( * ) Notice: Subject to any disclaimer, the term of this patent is extended or adjusted under 35 U.S.C. 154(b) by 0 days.

(21) Appl. No.: 09/531,926

(22) Filed: Mar. 21, 2000

(51) Int. Cl.[7] ..... F25C 1/12
(52) U.S. Cl. ..... 62/74; 62/347
(58) Field of Search ..... 62/1, 59, 66, 340, 62/347, 74

(56) References Cited

U.S. PATENT DOCUMENTS

| | | | | | |
|---|---|---|---|---|---|
| 4,351,157 | A | * | 9/1982 | Zeigler | 62/1 |
| 4,474,023 | A | * | 10/1984 | Mullins, Jr. | 62/347 |
| 4,907,415 | A | * | 3/1990 | Stewart, Jr. et al. | 62/66 |
| 5,018,360 | A | | 5/1991 | Jones | 62/66 |
| 5,031,417 | A | * | 7/1991 | Chang | 62/347 |
| 5,237,837 | A | * | 8/1993 | Naruse et al. | 62/347 |
| 5,419,151 | A | * | 5/1995 | Minari et al. | 62/347 |

* cited by examiner

*Primary Examiner*—William E. Tapolcai

(57) ABSTRACT

The present invention relates to an apparatus and method of forming ice and/or frost on predetermined locations of sculptures. The apparatus circulates a refrigerant through tubing that forms a closed-loop system. The apparatus includes a means to circulate the refrigerant, preferably a compressor, and a means to cool the refrigerant, preferably a condenser assembly including a fan. To keep the apparatus operating most efficiently, a drier/filter and a metering device are preferably used within the system. A portion of the tubing carrying the refrigerant is placed immediately adjacent the sculpture surface to be cooled, and it is preferably attached by solder. As cooled refrigerant circulates through the portion attached to the sculpture surface, the sculpture surface is cooled to promote ice and/or frost formation on the sculpture surface from moisture in the ambient air surrounding the sculpture surface. The apparatus may also include a means to deliver a fluid, such as water, to the sculpture surface. When the fluid comes into contact with the sculpture surface, it solidifies (turns to ice) on the surface. It is also preferable to include a fluid reservoir with the apparatus to supply the fluid to the surface. A housing may be used to conceal parts of the apparatus as well as structurally support the sculpture. In one embodiment the sculpture surface cooled is in the shape of a leaf, wherein frost and ice are formed on the leaf.

14 Claims, 3 Drawing Sheets

APPARATUS AND METHOD FOR FORMING ICE AND FROSTED SCULPTURES

BACKGROUND

The present invention relates to an apparatus and method for creating ice and frosted sculptures. More particularly, it concerns an apparatus for forming these sculptures with refrigeration equipment to cool a surface of the sculpture sufficient to cause frost and ice to form on the surface from water vapor in the ambient air surrounding the surface and from water that is dripped onto the surface.

There are very few devices that can generate ice or frosted sculptures. Other than using a mold to form an ice sculpture, some of these devices use standard refrigeration equipment to create the ice or frost from water vapor in the ambient air surrounding the sculpture. For example, an apparatus of this type is described in U.S. Pat. No. 4,351,157, issued to Ziegler on Sep. 28, 1982. This device uses a compressor and a condenser to circulate and cool a refrigerant through a closed-loop system formed in part from a series of stacked helical coils in a predetermined shape. The stacked helical coils form the shape of the sculpture along with a metallic sheath that encases the stacked coils. The circulating refrigerant cools the coils and the sheath, thereby cooling the ambient air surrounding the coils and sheath. Initially, this causes a layer of frost to form on the sheath from water vapor in the ambient air surrounding the sheath. Thereafter, successive layers of frost are formed and transformed into a layer of ice, according to the patent. One disadvantage of this apparatus is that it requires a stack of helical coils to generate the cooling power necessary to form ice, which significantly limits the shape of the sculpture than can be formed since the shape of the sculpture is based on the stacking of the coils. Moreover, sculptures made according to Ziegler are extremely difficult and costly to make for relatively complex shapes as compared to the present invention.

Another apparatus that generates frosted sculptures is described in U.S. Pat. No. 5,018,360, issued to Jones on May 28, 1991. Similar to Ziegler above, the Jones' apparatus uses a compressor and a condenser to circulate cooled refrigerant through a closed-loop system. Instead of using stacked helical coils to circulate the refrigerant and form the shape of the sculpture, Jones circulates the refrigerant through a conduit that is shaped to form the sculpture. In this regard, the conduit actually forms part of the sculpture along with frost that forms thereon. In other words, the Jones conduit acts as a skeleton for frost growth. As a result of the cooled refrigerant circulating through the conduit (made of a thermally conductive material), water vapor in the ambient air around the conduit forms a layer of frost on the outer surface of the conduit. Jones has at least two disadvantages. First, since the conduit is merely a length of thermally conductive tubing, the shape of the sculpture is limited to that which can be formed by the conduit itself and minor modifications firther described in the Jones patent. Second, this apparatus only generates frosted sculptures and not ice sculptures.

The present invention uses elements never considered in the prior art to produce both frosted and ice sculptures and provides the flexibility needed to create a much wider variety of sculptures, unencumbered by the limitations inherent in the prior art.

SUMMARY OF THE INVENTION

The present invention is an apparatus and method for creating ice and/or frosted sculptures. The apparatus utilizes means to circulate and cool a refrigerant through a closed-loop system. The means to circulate and cool can include standard refrigeration equipment, such as a compressor and a condenser operatively coupled to the system. A section of the closed-loop system that contains the cooled refrigerant is attached or in close proximity to a sculpture surface. Preferably, the section is attached to the sculpture surface by silver soldering. The cooled refrigerant thereby reduces the temperature of the sculpture surface so that moisture in the ambient air surrounding the sculpture surface is cooled sufficiently to form frost and ice on the sculpture surface. Also, a fluid supply (e.g., water) and a means to distribute the fluid supply (e.g., a pump) may be utilized to provide fluid to the cooled sculpture surface to encourage additional ice formation on the sculpture surface.

DETAILED DESCRIPTION OF THE PREFERRED EMBODIMENTS

Figure 1:
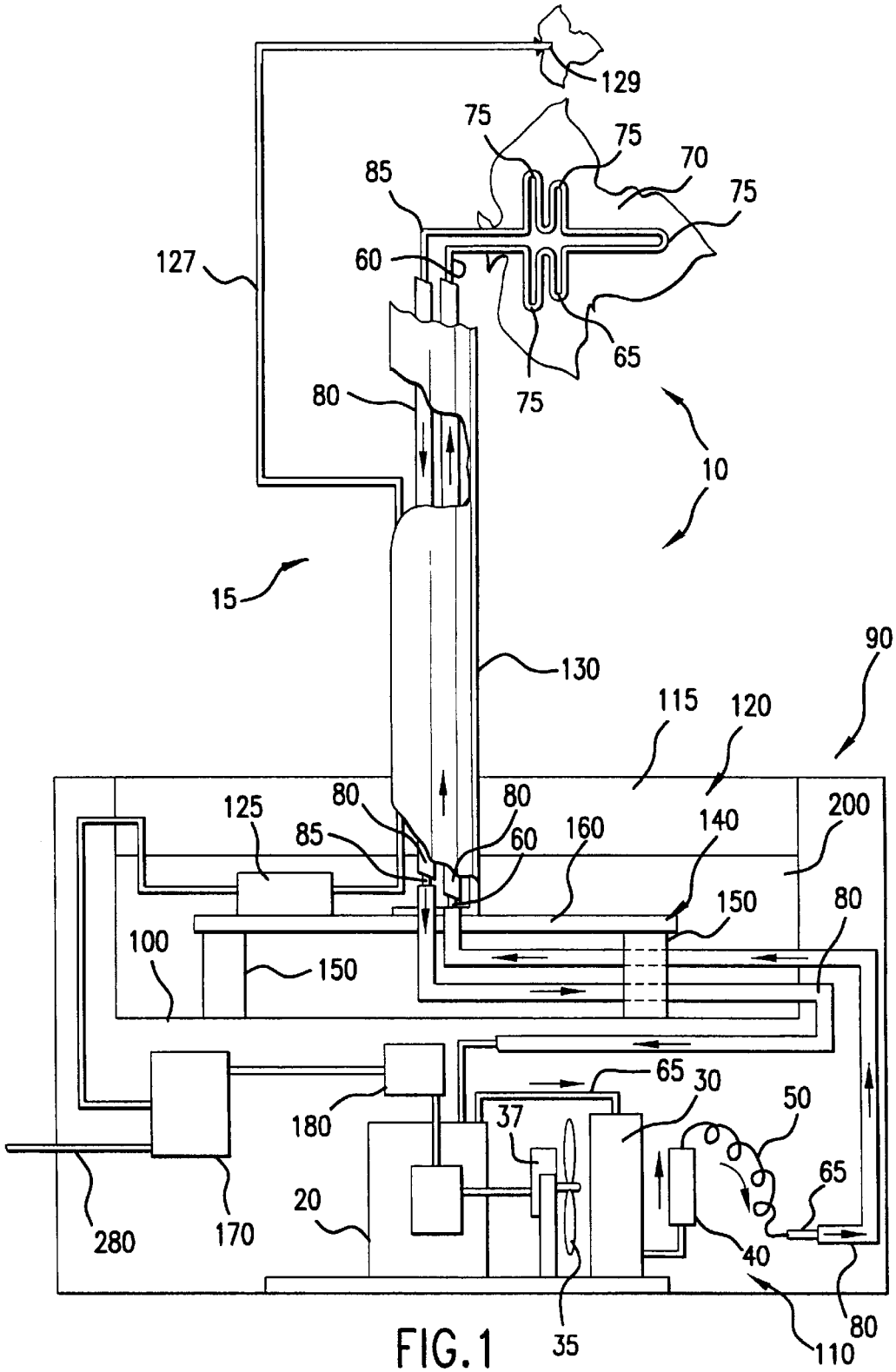
FIG. 1 is a schematic diagram of an embodiment of the present invention with arrows showing the flow path of refrigerant circulating through the apparatus.

Referring to the drawings, FIG. 1 is a schematic showing a preferred embodiment of an apparatus 10 for creating ice and/or frosted sculptures. The apparatus 10 utilizes a closed-loop system circulating a pressurized, cooled refrigerant or freezing agent there through. The refrigerant is preferably trifluoroethane, pentafluoroethane, tetrafluoroethane, dichlorodifluoromethane, or other chemicals commonly known by those skilled in the art of refrigeration. As a convenient starting point in the closed-loop system, a pressurizing means, such as a compressor 20, is used to create a pressure differential within the system so that the refrigerant can be circulated through the system. Pressurized refrigerant exits the compressor 20 at a relatively high pressure and is circulated through the system in the direction shown by the arrows. Typically, the refrigerant emerges from the compressor 20 as a pressurized gas at a temperature higher than what will be needed to cool the sculpture surface 70 to form the ice and frost, as further described herein. The relatively hot gaseous refrigerant then passes through a means to cool the refrigerant, such as a condenser 30 and a fan 35 driven by a fan motor 37 so that it becomes a liquid capable of cooling the sculpture further downstream. Preferably, the fan 35 or another cooling means should also cool the compressor 20 to keep it operating efficiently. Fan 35 may be controlled with a variable speed motor having a manual speed control for cooling the refrigerant and causing it to pass from a gas to a liquid state. After the refrigerant is cooled, it preferably passes through a drier/filter 40. The drier/filter 40 reduces moisture and particulate contamination from the system. Preferably, the drier/filter 40 is a desiccant, such as Silica Gel, as is commonly understood in the refrigeration field. After passing through the drier/filter 40, the refrigerant preferably flows through a metering device to reduce its pressure. Preferably, the metering device 50 is a capillary tube, but a thermoexpansion valve, an evaporator-pressure regulator valve, or other metering devices can also be used. As is known in the art, the capillary tube may be formed into a helical coil in order to conserve space. It should be understood that the metering device 50 can be any where in the system between the compressor 30 and the evaporator 60, further discussed below.

Compressor 20, condenser 30, condenser 30, fan 35, fan motor 37, and the electrical connections for operating these components can be purchased as a single assembly, known as a condensing unit to those skilled in the field. It has been found that a Tecumseh Condensing Unit is preferred for the invention embodied in the FIGS. The preferred condensing unit for the embodiment in the FIGS. is a 0.33 hp, 115V, low temperature, air cooled unit.

After exiting the metering device 50, the cooled refrigerant then flows through a predetermined length of refrigerant tubing 65 that acts as an evaporator 60. As the evaporator 60, the refrigerant tubing 65 extends from the metering device 50 to a surface of the sculpture 70 to be cooled. This configuration allows the refrigeration equipment discussed above to be located at a remote location from the sculpture merely by lengthening the evaporator 60 (i.e., using a greater length of refrigerant tubing 65 from the metering device 50 to the sculpture surface 70 to be cooled). However, the greater the length of tubing needed, the less cooling power the tubing will have when it reaches the surface of the sculpture 70 because of heat transfer from the ambient air through the tubing, to the refrigerant. Therefore, to maximize the system's cooling power, it is preferred to insulate the refrigerant tubing 65 after the refrigerant exits the metering device 50 to maintain it at a temperature as close as possible to the temperature of the refrigerant where it exits the metering device 50. Thus, FIG. 1 shows insulation 80 surrounding a significant portion of the refrigerant tubing 65 that carries the refrigerant from the metering device 50 to the surfaces of the sculpture to be cooled. To the extent that the tubing is too long and/or not effectively insulated, the refrigerant's temperature may rise too much before reaching the sculpture surface 70 to sufficiently cool the sculpture surface 70 to encourage ice and/or frost formation. Moreover, insulation 80 is provided around most of the refrigerant tubing 65 to minimize heat transfer from the ambient air to the refrigerant except in the area where the refrigerant tubing is near or attached to the sculpture surface 70. Preferably, the refrigerant tubing 65 should be made from copper, aluminum, or another highly thermally-conductive material to enable the surfaces of the sculpture to be sufficiently cooled, as further described. As heat is transferred from the ambient air, moisture in the ambient air surrounding the tubing may form frost on the outer surface of the tubing if the tubing is not well insulated.

As shown in FIG. 1, the refrigerant tubing 65 reaches the sculpture surface 70 and is immediately adjacent and preferably attached to the sculpture surface 70 so that the surface 70 is sufficiently cooled to encourage ice and/or frost to form on the surface 70 from moisture in the ambient air and/or from an external water supply provided to the sculpture surface 70. In the FIGS., the surface 70 is shown to be in the shape of a leaf, but the surface 70 to be cooled is not limited to this shape. The sculpture surface 70 is preferably made from copper, aluminum, or another highly thermally conductive material. Preferably, the tubing is soldered to the sculpture surface 70 (e.g., silver-soldering) at solder points 75 to maximize heat transfer between the surface 70, the refrigerant tubing 65, and the refrigerant. Soldering is also preferred because the heat required for soldering is sufficiently low to prevent damage to the sculpture surface 70 when the refrigerant tubing 65 is attached to the sculpture surface 70. It should be understood that the sculpture surface 70 can be a plurality of surfaces and/or other shaped surfaces that can be sufficiently cooled. It will be appreciated by those skilled in the art that the sculpture surface 70 may take any form that is desired by the artist. The desired sculpture may range from a miniature size to the largest of scale.

After the refrigerant passes through the section of the tubing where it cools the sculpture surface 70, it returns to the compressor 20 via a suction line 85. The suction line 85 is merely another length of refrigerant tubing 65. Preferably, the temperature of the refrigerant should be maintained as low as possible (by preventing additional heat transfer from the air to the refrigerant) as it returns to the compressor 20 so that it is easier to re-cool the refrigerant for recirculation. FIG. 1 shows the suction line 85 passing back though insulation 80, returning to the compressor 20. As the refrigerant returns to the compressor 20, the refrigerant has completed one full loop, needing to be pressurized and cooled again so that it can be continuously circulated through the system to maintain the ice and frost formed on the desired sculpture surface 70.

Figure 2:
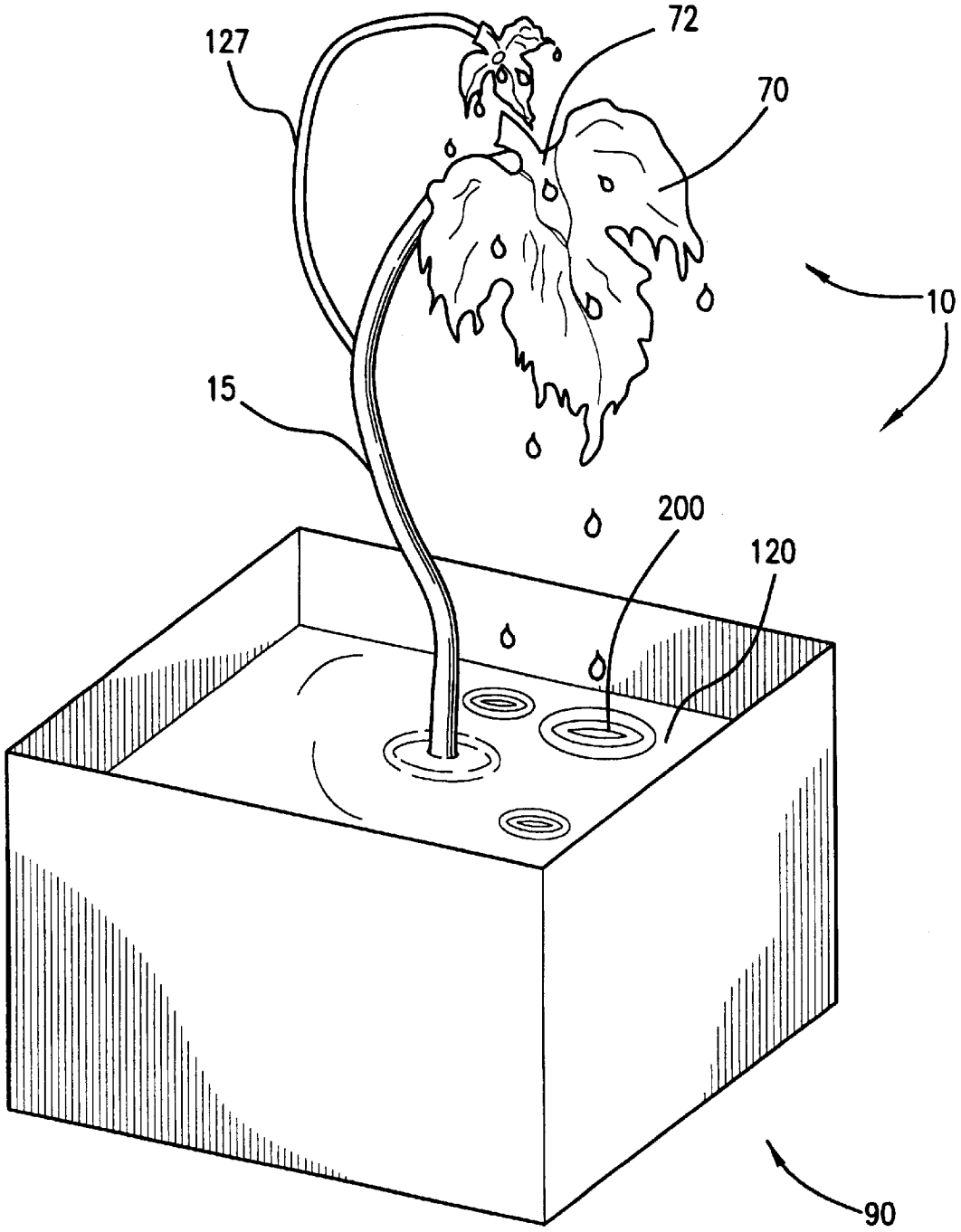
FIG. 2 is an isometric view of a sculpture that is made in accordance with the principles of the present invention.

There are a number of preferred structural considerations and other equipment in the embodiment of the FIGS. that will now be described in more detail. None of the following structural considerations are required for the apparatus 10 to function, but are provided as a preferred method of displaying the particular sculpture of FIGS. 1–3. Although not required, the condensing unit and other equipment should be hidden from viewers so that it does not detract from the aesthetic value of the sculpture. Preferably, the condensing unit is hidden within a main housing 90. The main housing 90 is merely an encasing for some of the components of the apparatus 10. In FIGS. 1 and 2, the main housing 90 contains the compressor 20, fan 35, condenser 30, drier/filter 40, metering device 50 and other equipment. The shape of the main housing 90 should not be limited to that shown in the FIGS. The main housing 90 is shown as a rectangular box with a cover plate 100 to conceal most, if not all, of the cooling and/or refrigeration equipment from a viewer. The cover plate 100 divides the main housing 90 into two sections—a first section 110 that houses many of the components of the apparatus 10 and a second section 115 that is used to support the sculpture and/or provide a fluid reservoir 120 as described further below.

Preferably, the apparatus 10 should also include and utilize a fluid supply 200, preferably water, so that the fluid can be distributed to the cooled surface of the sculpture 70 to encourage additional ice formation. The fluid supply 200 need not be integral with the apparatus 10, although it is shown within the second section 115 of the main housing 90 in FIG. 1.

If the second section 115 is used as the reservoir 120, the cover plate 100 must not allow water (or another fluid if used) to seep from the second section 115 of the main housing 90 to the first section 110 of the main housing 90 to protect the various equipment within the first section 110. Preferably, the reservoir 120 also contains a means to deliver the fluid, such as a pump 125, from reservoir 120 to the desired cooled sculpture surface 70. The pump125 is operatively coupled to water tubing127 to transport the water from the reservoir 120 to the cooled sculpture surface 70. Preferably, the water tubing 127 is made from plastic or nylon and the water is delivered to a location above the sculpture to be dripped onto the sculpture surface 70. The specifications for the preferred pump 125 used in the embodiment of FIGS. 1 and 2 are 0.45 Amps, 115 Volts and 50/60 Hz. The water tubing 127 is preferably at least partially hidden from view as it approaches the cooled sculpture surface 70. As shown in FIGS. 1 and 2, the water tubing 127 is partially concealed within an evaporator housing 130, further described below, emerges and then continues to a point above the cooled sculpture surface 70.

Figure 3:
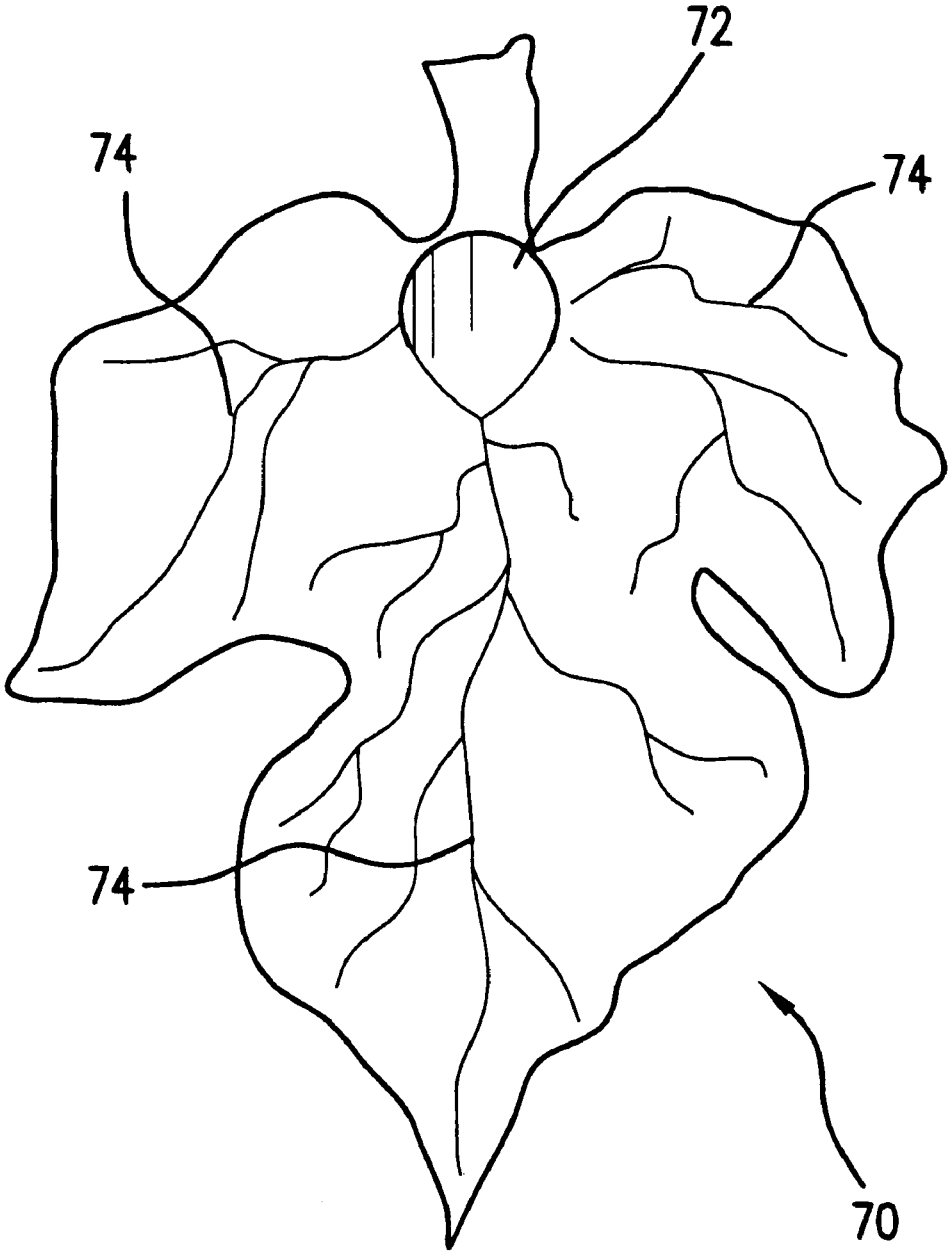
FIG. 3 is an isometric view of the sculpture surface of FIG. 1 showing an area designed to allow fluid to collect on the sculpture surface.

Preferably, a flow rate controlling device 129 is used near the end of the water tubing 127 to control the flow rate of the water onto the cooled sculpture surface 70. A manual valve 129 with or without a timer, a solenoid valve or any other device capable of controlling the flow rate can be used. The valve can be positioned any where along the water tubing 127 as long as it effectively controls the flow rate of water onto the sculpture surface 70. As the water drips onto the cooled sculpture surface 70, it will freeze and form ice as it flows over the cooled surface. Any water that does not freeze, preferably drips off of the substrate and onto the cover plate 100 and/or into the reservoir 120, as shown in FIG. 2. It should be noted that as the water drips onto and flows over the surface, it may not freeze because of the kinetic energy imparted to the water. Therefore, as shown in FIG. 3, it may be necessary to create a slight depression or other structural modification 72 in a portion of the sculpture surface 70 to slow the flow rate of the water as it travels on the surface to promote ice formation. The sculpture surface 70 is shown as having a series of indentations 74, resembling the veins of a leaf, to channel the water over the surface. The sculpture surface 70 may be modified in different ways to allow the water provided to the sculpture surface 70 to collect locally on the surface and slowly disperse over the surface.

Within the main housing 90, there may also be a mounting perch 140 to assist in supporting the sculpture. In FIG. 1, the mounting perch 140 is shown as preferably being in the second section 115 of the main housing 90 and below the water line of the fluid reservoir 120. The mounting perch 140 is shown resting on the cover plate 100 as four vertical members 150 (two shown, with the other two behind the two shown) and one horizontal member 160. The shape and location of the mounting perch 140 can be changed or it may be not used at all, depending on the sculpture formed. With the particular embodiment of FIG. 1, the mounting perch 140 supports the stem 15 and the entire sculpture.

The stem 15 of the sculpture of FIGS. 1 and 2 is configured to be an evaporator housing 130. As shown in the cut-away portion of the stem 15 of FIG. 1, the refrigerant tubing 65 is encased within the evaporator housing 130. The evaporator housing 130 may be of any material that can effectively support the sculpture. The evaporator housing 130 of FIG. 1 is made of copper for aesthetic reasons and includes insulation 80 between the refrigerant tubing 65 and evaporator housing 130 to minimize heat transfer from the ambient air to the refrigerant, for the reasons previously discussed. Preferably, the insulation is foam rubber, but other types of insulation, such as Styrofoam, and other insulation commonly known by those skilled in the art can be used. Preferably, the insulation is sufficient to prevent frost formation on the outside surface of the evaporator housing 130.

There may be a number of connections between the refrigerant tubing 65 and various structural members of the apparatus 10, depending on the sculpture and main housing 90 configuration used. Many of these connections should be leak-proof to protect various components and/or the surroundings of the sculpture. For example, in FIG. 1, as the refrigerant flows passed the capillary tube, it travels up the main housing 90 until it penetrates a side wall of the reservoir 120. The refrigerant tubing 65 is preferably waterproof-sealed to the reservoir 120 as it passes through the reservoir 120 to prevent water leakage from the reservoir 120 to the refrigeration equipment and floor of the main housing 90. Similarly, as the refrigerant tubing 65 returns to the compressor 20, it is shown to pass through the side wall of the reservoir 120 once again. Therefore, the refrigerant tubing 65 should be waterproof-sealed to the side wall as discussed above.

The refrigerant tubing 65 is also shown to pass through the horizontal surface of the mounting perch 140 as the refrigerant tubing 65 approaches the sculpture surface 70 and as it returns to the compressor 20. The mounting perch 140 only needs to have holes to allow the refrigerant tubing 65 to pass through. The holes are preferably small enough to assist in supporting the refrigerant tubing 65 as it travels upward to the sculpture surface 70 and back downward as part of the suction line 85.

The evaporator housing 130 is preferably attached to the mounting perch 140 to further assist in supporting the sculpture. The evaporator housing can be threadably attached or brazed to a flange on the mounting perch.

Although not required, other preferred components of the apparatus 10 include a timer 170 and one or more pressure controls 180. The timer 170 can be used to cycle on and off, the fluid delivering means and/or the refrigerant circulating means. The timer 170 can be designed to control the compressor 20 and water pump 125 separately or together allowing the apparatus 10 to be in continuous operation for predetermined periods. The water pumping means need not be in operation the entire time the apparatus 10 circulates the refrigerant. The timer 170 is preferably a single pole, single throw on/off time clock with a twenty-four hour timer, but the timer 170 may be any other device commonly understood in the field.

The pressure control 180 may include a low pressure control and/or a high pressure control. The low pressure control is a switch that turns off the compressor 20 if the pressure of the system is too low (e.g., refrigerant leak). The high pressure control is a switch that turns off the compressor 20 if the pressure gets too high. Both pressure controls are safety features that are preferably included with the apparatus 10.

The power supply for the apparatus 10 is not shown in FIG. 1, but a main load line 280 leading to a power supply is shown. Preferably, all of the equipment that requires electrical power can be provided via the main load line 280 connected to a standard electrical outlet. It should be understood that each individual component or multiple components can be powered by separate electrical power supplies, as commonly understood in the field.

Another possible use for the apparatus 10 is to automatically water plants that are placed under the sculpture surface 70 (not shown in FIGS.). In this regard, it is possible to have water drip from the sculpture surface 70 onto the plant. The timer 170 can be used to cycle the apparatus on and off so that after ice forms on the sculpture surface, it is then allowed to melt to provide water to the plant.

Another possible use for the apparatus 10 is as a space dehumidifier. This is a result of the apparatus 10 removing moisture from the ambient air to form frost and ice on the sculpture surface 70. As frost forms on the sculpture surface 70, the relative humidity of the air surrounding the surface 70 is lowered. Thus, if the apparatus 10 is operated in a closed room, the relative humidity of the ambient air within the room may decrease.

While the invention has been shown and described herein with reference to particular embodiments, it is to be understood that the various additions, substitutions, or modifications of form, structure, arrangement, proportions, materials, and components and otherwise, used in the practice of the invention and which are particularly adapted to specific environments and operative requirements, may be made to the described embodiment without departing from the spirit and scope of the present invention. It should be understood that the particular specifications for many of the components (e.g., length of refrigerant tubing 65, power of compressor 20, speed of fan 35, length of capillary tube 50, etc.) will depend on the size of the sculpture surface 70 to be cooled, the length of the evaporator, the sufficiency of the insulation 80, the amount of moisture in the ambient air, and other factors known by those skilled in the art. In this regard, U.S. Pat. No. 4,351,157 to Ziegler and U.S. Pat. No. 5,018,360 are hereby incorporated by reference.

We claim:

1. An apparatus for creating an ice and frosted sculpture surface comprising:

a sculpture having a sculpture surface;

a length of tubing forming a closed loop system wherein a portion of said tubing is attached to the sculpture surface;

a means for removing heat from the sculpture surface operatively connected to the length of tubing wherein frost or ice is encouraged to form on the sculpture surface adjacent the portion of tubing attached to the sculpture surface from moisture in the ambient air surrounding the sculpture surface; and a means for providing a fluid to the sculpture surface.

2. The apparatus of claim 1, further comprising a housing, wherein the housing conceals a portion of said means for removing heat.

3. The apparatus of claim 2, wherein the housing structurally supports the sculpture.

4. An apparatus for creating an ice and frosted sculpture surface comprising:

a sculpture having a sculpture surface;

a length of tubing forming a closed-loop system;

a compressor operatively coupled to the tubing within the system;

a metering device;

a condenser operatively coupled to the tubing within the system wherein the metering device is operatively coupled to the tubing within the system between the condenser and the sculpture surface, wherein a portion of the tubing is attached to the sculpture surface, the closed-loop system contains a refrigerant, and the refrigerant is cooled and circulated to cool the sculpture surface sufficiently to encourage frost or ice to form on the sculpture surface from moisture in the ambient air surrounding the sculpture surface; and a means for providing a fluid to the sculpture surface.

5. The apparatus of claim 4, further comprising a filter operatively coupled to the system between the condenser and the sculpture surface.

6. The apparatus of claim 4, further comprising a drier operatively coupled to the system between the condenser and the sculpture surface.

7. The apparatus of claim 4, wherein the metering device is a capillary tube.

8. The apparatus of claim 4, wherein the portion of tubing attached to the sculpture surface is attached by solder.

9. The apparatus of claim 4, further comprising a pump for delivering a fluid to the sculpture surface.

10. The apparatus of claim 9, further comprising a fluid reservoir to contain a fluid to be delivered to the sculpture surface.

11. The apparatus of claim 10, wherein the refrigerant removes heat from the sculpture surface sufficient to cause the fluid delivered to the sculpture surface to change to a solid state after coming into contact with the sculpture surface.

12. An apparatus for forming frost and ice on a cooled sculpture surface comprising:

a sculpture having a sculpture surface;

a length of tubing forming a closed-loop system;

a compressor operatively coupled to the tubing within the system;

a condenser operatively coupled to the tubing within the system;

a metering device operatively coupled to the tubing within the system between the condenser and the sculpture surface;

a filter operatively coupled to the tubing within the system between the condenser and the sculpture surface;

a pump for delivering a fluid to the sculpture surface; and a fluid reservoir for holding the fluid;

wherein a portion of the tubing is attached to the sculpture surface by solder, the closed-loop system contains a refrigerant, and the refrigerant sufficiently cools the sculpture surface to encourage frost to form on the surface from moisture in the ambient air surrounding the sculpture surface.

13. A method of creating an ice and frosted sculpture with a cooled sculpture surface comprising the steps:

providing a sculpture having a sculpture surface;

circulating refrigerant continuously through tubing that forms a closed-loop system, wherein a portion of the tubing is attached to the sculpture surface;

cooling the refrigerant sufficiently prior to the refrigerant reaching the portion of the tubing attached to the sculpture surface to encourage heat transfer from the sculpture surface to the refrigerant so that frost forms on the sculpture surface from moisture in the ambient air surrounding the sculpture surface; and bringing a fluid into contact with the sculpture surface wherein the fluid transforms to a solid state upon coming into contact with the sculpture surface.

14. The method of claim 13, further comprising the step of circulating the refrigerant through a metering device operatively coupled to the system, wherein the metering device is located between the point at which the refrigerant is cooled and the sculpture surface.

* * * * *